US006641009B2

(12) United States Patent
French et al.

(10) Patent No.: US 6,641,009 B2
(45) Date of Patent: Nov. 4, 2003

(54) HANDGUN HOLSTER

(75) Inventors: John M. French, Boise, ID (US); Thomas A. Marx, Portland, OR (US)

(73) Assignee: Michaels of Oregon Co., Oregon City, OR (US)

( * ) Notice: Subject to any disclaimer, the term of this patent is extended or adjusted under 35 U.S.C. 154(b) by 0 days.

(21) Appl. No.: 10/177,585

(22) Filed: Jun. 19, 2002

(65) Prior Publication Data

US 2002/0153396 A1 Oct. 24, 2002

Related U.S. Application Data

(63) Continuation of application No. 09/711,360, filed on Nov. 9, 2000, now abandoned.

(51) Int. Cl.[7] ..... F41C 33/02

(52) U.S. Cl. ..... 224/244; 224/193; 224/911; 382/115; 382/124; 382/126

(58) Field of Search ..... 224/193, 243, 224/244, 587, 911, 912; 382/115, 124, 126; 42/1.01, 70.11

(56) References Cited

U.S. PATENT DOCUMENTS

| | | | | |
|---|---|---|---|---|
| 1,113,530 | A | | 10/1914 | Audley |
| 1,173,376 | A | | 2/1916 | Noye |
| 2,251,913 | A | | 8/1941 | Brennan |
| 3,419,728 | A | | 12/1968 | Wilson |
| 3,530,451 | A | | 9/1970 | Devine |
| 3,558,090 | A | | 1/1971 | Bird |
| 3,939,679 | A | | 2/1976 | Barker et al. |
| 4,256,243 | A | | 3/1981 | Bianchi et al. |
| 4,277,007 | A | | 7/1981 | Bianchi et al. |
| 4,354,189 | A | | 10/1982 | Lemelson |
| 4,467,545 | A | | 8/1984 | Shaw, Jr. |
| 4,488,370 | A | | 12/1984 | Lemelson |
| 4,694,980 | A | | 9/1987 | Rogers |
| 4,747,280 | A | | 5/1988 | Shawb |
| 4,768,021 | A | | 8/1988 | Ferraro |
| 4,846,384 | A | | 7/1989 | Perry |
| 4,858,799 | A | * | 8/1989 | Young ..... 224/238 |
| 4,858,800 | A | | 8/1989 | Holtzclaw, Jr. et al. |
| 4,912,867 | A | | 4/1990 | Dukes, Jr. |
| 4,925,075 | A | | 5/1990 | Rogers |
| 4,944,021 | A | | 7/1990 | Hoshino et al. |
| 4,995,086 | A | | 2/1991 | Lilley et al. |
| 5,018,654 | A | | 5/1991 | Rogers et al. |
| 5,094,376 | A | | 3/1992 | Baruch |
| 5,189,894 | A | | 3/1993 | Buck |
| 5,245,329 | A | | 9/1993 | Gokcebay |
| 5,337,043 | A | | 8/1994 | Gokcebay |

(List continued on next page.)

FOREIGN PATENT DOCUMENTS

| | | |
|---|---|---|
| DE | 003222112 A1 | 3/1984 |
| JP | 01244089 | 9/1989 |
| JP | 408086149 A | 4/1996 |
| WO | WO 8808170 A1 | 10/1988 |

OTHER PUBLICATIONS

Brown, Chappell, "Self–contained fingerprint IDs forgo PCs, network," EETIMES, pp. 1–3, Issue 1039, Dec. 14, 1998.

*Primary Examiner*—Stephen K. Cronin
(74) *Attorney, Agent, or Firm*—Chernoff, Vilhauer, McClung & Stenzel, LLP

(57) ABSTRACT

A handgun holster has a body defining a handgun receiving pocket. The holster includes a retention device proximate to said pocket and capable of selectively resisting withdrawal of said handgun from said holster. The holster also includes a biometric device capable of sensing a characteristic of an individual, and being effective to selectively release said handgun from said holster.

29 Claims, 8 Drawing Sheets

U.S. PATENT DOCUMENTS 5,419,474 A 5/1995 Marx et al.
5,449,103 A 9/1995 Tilley
5,479,149 A 12/1995 Pike
5,502,915 A 4/1996 Mendelsohn et al.
5,503,157 A * 4/1996 Sramek ..... 600/506
5,508,683 A 4/1996 Hall
5,513,785 A 5/1996 Campagna, Jr.
5,518,155 A * 5/1996 Gallagher ..... 224/242
5,525,966 A 6/1996 Parish
5,579,909 A 12/1996 Deal
5,598,151 A 1/1997 Torir, Jr.
5,603,179 A 2/1997 Adams
5,611,471 A * 3/1997 French ..... 224/243
5,701,770 A 12/1997 Cook et al.
5,719,950 A * 2/1998 Osten et al. ..... 340/5.82
5,779,114 A * 7/1998 Owens ..... 224/193
5,812,252 A 9/1998 Bowker et al.
5,828,301 A 10/1998 Sanchez
5,915,936 A 6/1999 Brentzel
5,916,087 A 6/1999 Owens
5,933,515 A 8/1999 Pu et al.
5,936,544 A 8/1999 Gonzales et al.
5,937,557 A 8/1999 Bowker et al.
5,944,239 A 8/1999 Rogers et al.
5,953,844 A 9/1999 Harling et al.
5,961,013 A 10/1999 Collins
5,987,941 A 11/1999 Zocco
6,230,946 B1 * 5/2001 Vor Keller et al. ..... 224/244
6,320,975 B1 * 11/2001 Vieweg ..... 224/193
2001/0019071 A1 9/2001 Vor Keller et al.
2001/0048009 A1 12/2001 Vor Keller et al.

* cited by examiner 46
50
14
47
58
51
52
44
16

56
46
50
14
47
52
58
64
45
51
51
66
60
54
44
45

56
55
46
68
64
14
52
47
58
50
66
60
48
54
45
44
16

HANDGUN HOLSTER

CROSS REFERENCE TO RELATED APPLICATIONS

This application is a continuation of U.S. patent application Ser. No. 09/711,360, filed Nov. 9, 2000, entitled HANDGUN HOLSTER, now abandoned.

BACKGROUND OF THE INVENTION

The present invention relates to a holster and more particularly to a handgun holster with an internal retention device for securing a handgun in the holster until its removal is desired by an authorized user such as the holster wearer. More particularly, the invention allows removal of the holster by releasing or unlocking the retention device only after recognizing an authorized user (such as the holster wearer and/or other authorized persons) by means of a discriminating biometric device, such as a fingerprint reader or identifier.

Handgun users, particularly those engaged in law enforcement, require a holster in which a handgun remains securely held until intentionally removed by the handgun user. The holster must retain the handgun securely during not only the normal movements of the user, but also during more vigorous activity. For example, the holster should securely hold the handgun even during physical contact such as when attempting to restrain another person or while being attacked by another person. But while the holster should resist unauthorized removal of the handgun, it should also permit rapid, safe and easy withdrawal of the handgun when its use is required by the user.

Previous holster designs have compromised at least one of these objectives. Either the holster retains the weapon against undesired or unauthorized removal but is difficult to operate by the wearer, or the holster is simple to operate but fails to provide the type or degree of retention desired for a given application.

Devices intended to provide for maximum security of a handgun in a holster are generally of two types. In one type, an external security strap, such as one including a thumb break, is attached to the holster. However, these types of devices are subject to slipping off of the handgun, or being cut or abraded, and therefore are not preferred.

In a second type, some form of internal retention device is added to the holster. While these devices may improve the ability of the holster to resist unauthorized withdrawal, these holsters have their own drawbacks. For example, Audley, U.S. Pat. No. 1,113,530 discloses a leather holster having a spring-biased locking lug, which engages the interior of the trigger guard of a handgun inserted into the holster. The lug is exposed to be pushed free from the trigger guard to permit removal of the handgun from the holster.

Rogers, U.S. Pat. No. 4,925,075 also discloses a holster having a spring-biased catch for engaging the trigger guard of a holstered handgun. The catch is shaped to allow the trigger guard to push it aside so that the handgun can be removed by moving it initially upward.

These holsters having an internal retention device do little to prevent the unauthorized removal of a holstered handgun from the holster by a person behind the wearer.

Bianchi et al., U.S. Pat. Nos. 4,256,243 and 4,277,007 disclose a holster having a spring-biased finger which projects into the area surrounded by the trigger guard of a handgun in the holster, but the finger is moved aside by the trigger guard during normal withdrawal of the handgun.

Perry, U.S. Pat. No. 4,846,384 discloses a top-opening holster, which includes a restraining wedge that projects into the trigger guard of a holstered handgun, but which is moved aside by the trigger guard as the handgun is rotated forward during withdrawal from the holster.

Rogers et al., U.S. Pat. No. 5,018,654 discloses a holster having a restraining device including bosses to engage the trigger guard, but which also are moved aside as the handgun is rotated forward during withdrawal.

None of these three retention devices prevents a holstered handgun from being removed vertically upward or from the front of the holster wearer by another person. In addition, these three holsters do not permit a handgun to be drawn with a simple, natural movement by the holster wearer, since the handgun must first be rocked forward to release it from the restraint.

Rogers, U.S. Pat. No. 4,694,980 discloses a holster having a restraining device that requires that two external straps be undone by the wearer and that the handgun then be rotated or rocked toward the rear in order to release it to the wearer. Not only does this holster not permit a handgun to be drawn with a simple, natural movement by the holster wearer, but it can also be difficult to use while seated or in confined spaces due to the downward or rearward direction required to release the weapon. Additionally, its complex, multi-step operation can be hard to master and confusing under stress.

Baruch, U.S. Pat. No. 5,094,376 discloses a holster in which pockets within the holster contain dowels, which project into an ejection port and the trigger guard of a pistol. The pistol is released by a rearward motion including an outwardly twisting movement of the pistol butt away from the wearer's body. Thus, overall removal of the pistol is not particularly easy, but pulling the pistol butt away from a wearer, as might be expected of someone other than the holster wearer trying to take the pistol, can help release the pistol.

Marx et al., U.S. Pat. No. 5,419,474 discloses a holster with an internal retention device which prevents the handgun from being removed from the holster until a slight inward rotation of the gun about an axis, generally parallel with the barrel of the handgun, is made. It permits easy and safe unholstering of the handgun while also permitting the holster wearer to keep his hand and wrist in a natural, locked, shooting position that begins with initial hand placement on the handgun and continues through removal of the handgun from the holster and on to the presentation of the weapon to the target. However, even here, while solving the problem of a more natural drawing movement, the weapon can still be removed by an unauthorized individual (as it can in all of the patents described above) if that individual knows and performs the required release movements, or, if during the course of a struggle for the handgun, the movements are reproduced merely by chance.

Wilson, U.S. Pat. No. 3,419,728 discloses a holster with a solenoid locking mechanism controlled by a push button switch. It eliminates any kind of special drawing movement by the wearer but offers little personal/individual security as anyone (the wearer, the attacker, etc.) could operate the push button.

Tilley, U.S. Pat. No. 5,449,103 discloses a holster that also employs a solenoid locking mechanism but it provides the wearer with a hand-mounted magnet in order to control a holster-mounted reed switch that, in turn, controls the opening of the solenoid. This holster provides a mechanism to identify an authorized user, but there are drawbacks to the magnetic device. For example, the magnetic device may be lost, damaged or not positioned correctly to release the handgun.

Sanchez, U.S. Pat. No. 5,828,301 discloses a holster with an external security strap that is controlled or released not by a movement on the part of the holster wearer but by means of a more sophisticated user identification device than Tilley. Sanchez offers two release options. The first option is a bar code reading system whereby the holster wearer also wears a predetermined bar code strip (generally on the drawing hand as a ring, band or glove), which is read and recognized by an appropriate reader contained somewhere on the holster. After a correct match is made, the strap is opened (released from its latching assembly), and the weapon may be removed. However, even here, several drawbacks exist. A primary drawback is that the wearer must always posses the bar code strip and must always place it in the proper position to be read. The alternative embodiment shown by Sanchez also requires that the pattern generator (an ultrasonic transmitter that broadcasts to a receiver mounted on the holster) be worn and positioned correctly. In either case, if the pattern generator is left behind or lost in a struggle, the holster cannot be readily opened. Conversely, if the pattern generator is obtained by someone other than the authorized user, then the holster may be released by someone other than the authorized user. If the pattern generator is somehow turned out of its normal orientation (as can easily happen with any ring, glove or transmitter bracelet), the holster cannot readily be opened. In addition, if the pattern generator becomes damaged (as can easily happen to either a bar code strip or solid state transmitter), the holster cannot be readily opened.

Furthermore, Sanchez employs an external retention strap, which is not as reliable for retaining a weapon within a holster as an internal retention device. For example, the external retention strap could merely be cut through or torn away by an attacker, thereby making the identification/retention system moot. Additionally, the external strap as described by Sanchez is not a passive device, meaning that the wearer is further burdened by having to manually refasten the lock each time the handgun is returned to the holster.

Accordingly, what is still desired is a holster having a retention device which securely holds the handgun but permits a holstered handgun to be withdrawn without the need of a specialized movement by the holster wearer and which also effectively resists unauthorized withdrawal of a handgun from the holster by an unauthorized person, that allows quick and reliable identification of an authorized individual, and that does not require an external device to release the holster.

BRIEF SUMMARY OF THE INVENTION

The present invention overcomes the aforementioned problems associated with prior art holsters by providing in a first aspect a handgun holster with a retention device which opens only after an authorized user is recognized by a biometric identification device and then allows the handgun to be removed in a natural motion. The handgun holster has a body defining a handgun receiving pocket. A retention device is proximate to the pocket and is capable of selectively resisting withdrawal of said handgun from the holster. The holster further includes a biometric device capable of sensing a characteristic of an individual, and being effective to control the internal retention device so as to release the handgun from the holster.

This aspect of the invention provides a holster that quickly and reliably releases a handgun from a holster only to authorized individuals based on a personal identifying characteristic sensed by the biometric device. There is no risk that a separate identifier such as a magnetic device, bar code or transmitter, may become lost or damaged, and thereby effectively prevent withdrawal of the handgun. In some embodiments, the holster may be provided with data representative of multiple authorized users so that multiple users are authorized to withdraw the handgun.

In a second aspect of the invention, a holster has a body defining a handgun receiving pocket. The holster includes an internal retention device proximate to the pocket capable of resisting withdrawal of the handgun from the holster. The internal retention device includes a catch capable of resisting withdrawal of the handgun from the holster, and a moveable blocking member. The blocking member in a first position resists movement of the catch, and in a second position allows movement of the catch.

This aspect of the invention provides an internal retention device which permits a holstered handgun to be withdrawn without the need of a specialized movement by the holster wearer and which also effectively resists unauthorized withdrawal of a handgun. The internal retention device has the advantage that movement of the catch is blocked by a blocking mechanism, thus indirectly resisting movement of the handgun from the holster.

In a third aspect of the invention, a handgun holster system for securely holding a handgun comprises a holster body defining a handgun receiving pocket. A sensing device located proximate said pocket is capable of sensing at least one of insertion of the handgun into or an attempt to withdraw the handgun from the holster and generating a signal in response to at least one of insertion and an attempt to withdraw the handgun. The holster includes a computer system connected to the sensing device. The computer system is also associated with a clock. The computer system, in response to receiving the signal from the sensing device, stores data representative of the signal and a time.

This aspect of the invention has the advantage that an audit record of the activity of the holster may be stored. When the handgun is either inserted or withdrawn, the computer stores the fact of insertion or withdrawal and the time. Thus, the holster activity may be monitored to determine whether the handgun has been withdrawn.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
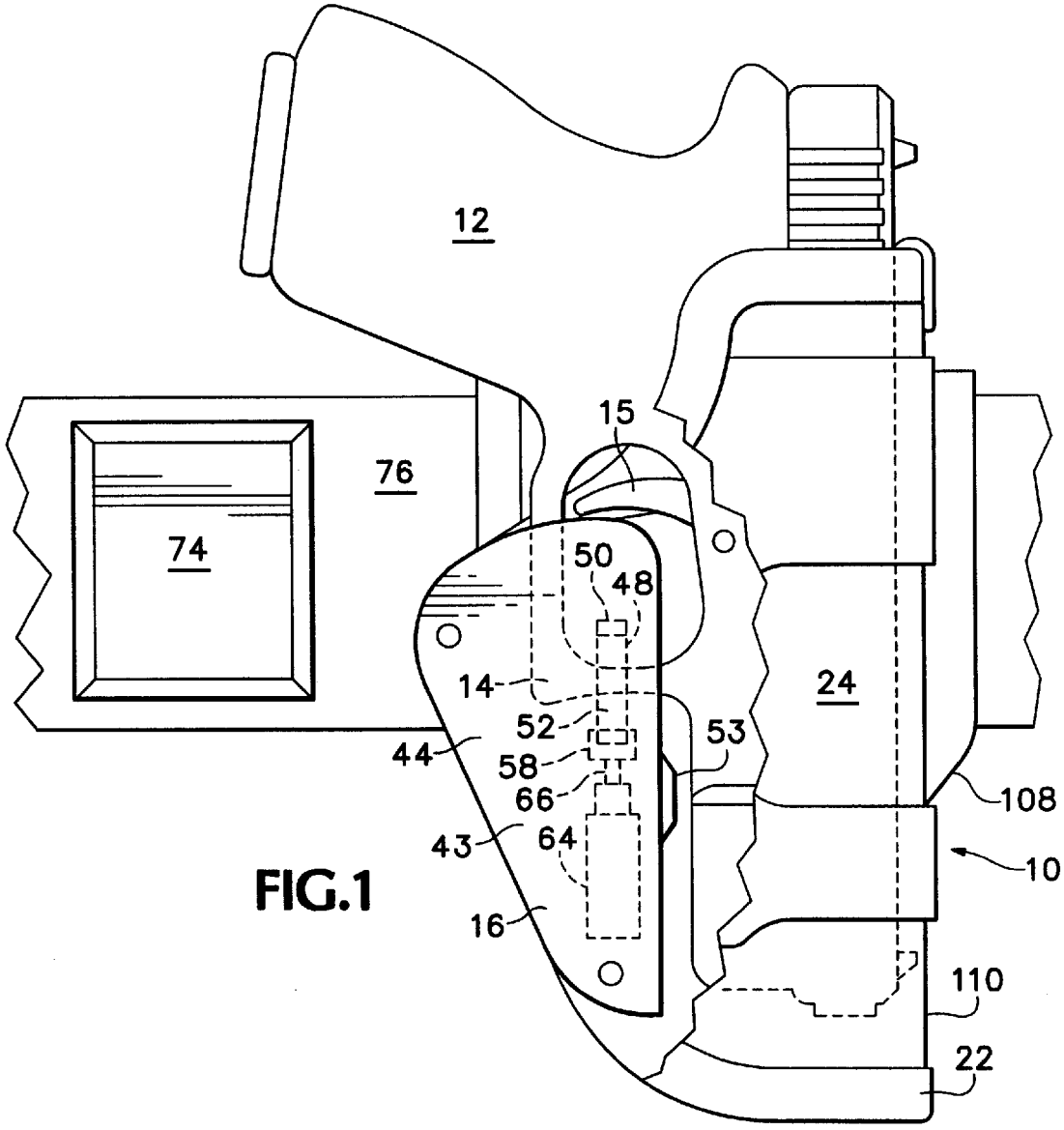
FIG. 1 is a side elevation view in partial cutaway of a holster of the present invention mounted to a belt.

Referring now to the figures, wherein like numerals refer to like elements, the present invention in one embodiment is directed toward a holster 10 shown in FIG. 1 that in normal operation allows only an authorized user, such as the wearer, to remove a handgun 12 from the holster. The holster has a retention device 16 that selectively resists unauthorized withdrawal of the handgun 12. In general, the holster 10 utilizes a biometric identification device such as a fingerprint recognition system, to release or otherwise unlock the retention device so that the handgun 12 may be withdrawn from the holster 10. The holster 10 includes a microprocessor connected to the biometric identification device. The retention device 16 is effectively controlled by the microprocessor. The microprocessor is associated with a memory containing the personal identifying characteristics, such as scanned fingerprints, of the user(s) authorized to withdraw the handgun 12 from the holster 10. When the biometric identification device senses a personal characteristic of a potential user, the microprocessor checks for a match in the memory, and if a match is found, sends a signal effective to control the retention device 16 so as to allow the handgun 12 to be withdrawn. The various components of the system are described in more detail below.

HOLSTER

Figure 1A:
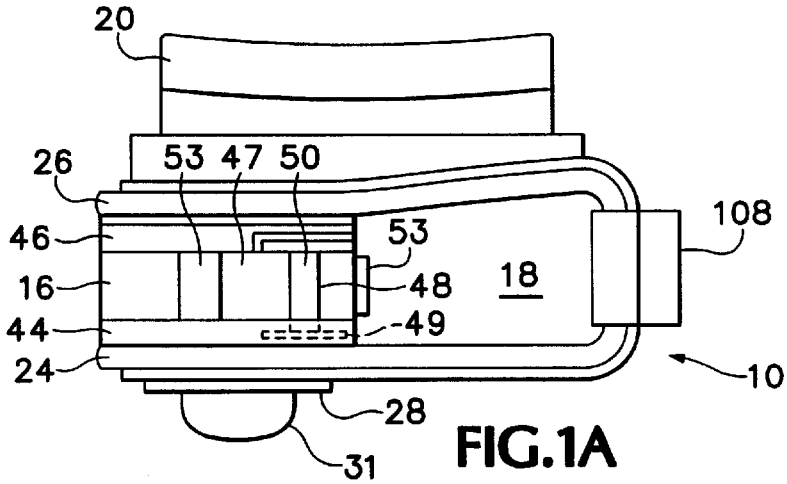
FIG. 1A is a top view of the holster of FIG. 1 showing the handgun receiving pocket.

The holster 10 has a body 22 which includes an outer side 24 and an inner side 26 which are interconnected. FIG. 1A shows the two sides interconnected by an internal retention device 16. Alternatively, the two sides may be connected by a welt or a similar interconnecting structure, to define the rear portion of an upwardly open or openable pocket 18 for receiving the handgun 12. The holster 10 may be made of conventional materials, such as leather, fabric such as nylon or canvas, or moldable materials such as plastic or polymeric materials such as KYDEX. An exemplary holster body is disclosed in Marx et al U.S. Pat. No. 5,419,474, the relevant disclosure of which is hereby incorporated by reference. The holster body 22 may be designed to receive a handgun 12 having a trigger guard 14, and may be sized to receive particular sizes or styles of handgun as necessary.

As shown in FIGS. 1 and 1A, the holster 10 may be attached to a belt loop 20 to attach the holster to a belt 76 worn by the user. A modular assembly 74 may be mounted on or attached to the belt 76, or alternatively the belt or holster body. The modular assembly may include electrical components to be used in association with the retention device 16 or the biometric identification device. As used herein, the term holster is used broadly and includes not only the body 22 but also any associated belt loop and/or modular assembly.

Figure 4:
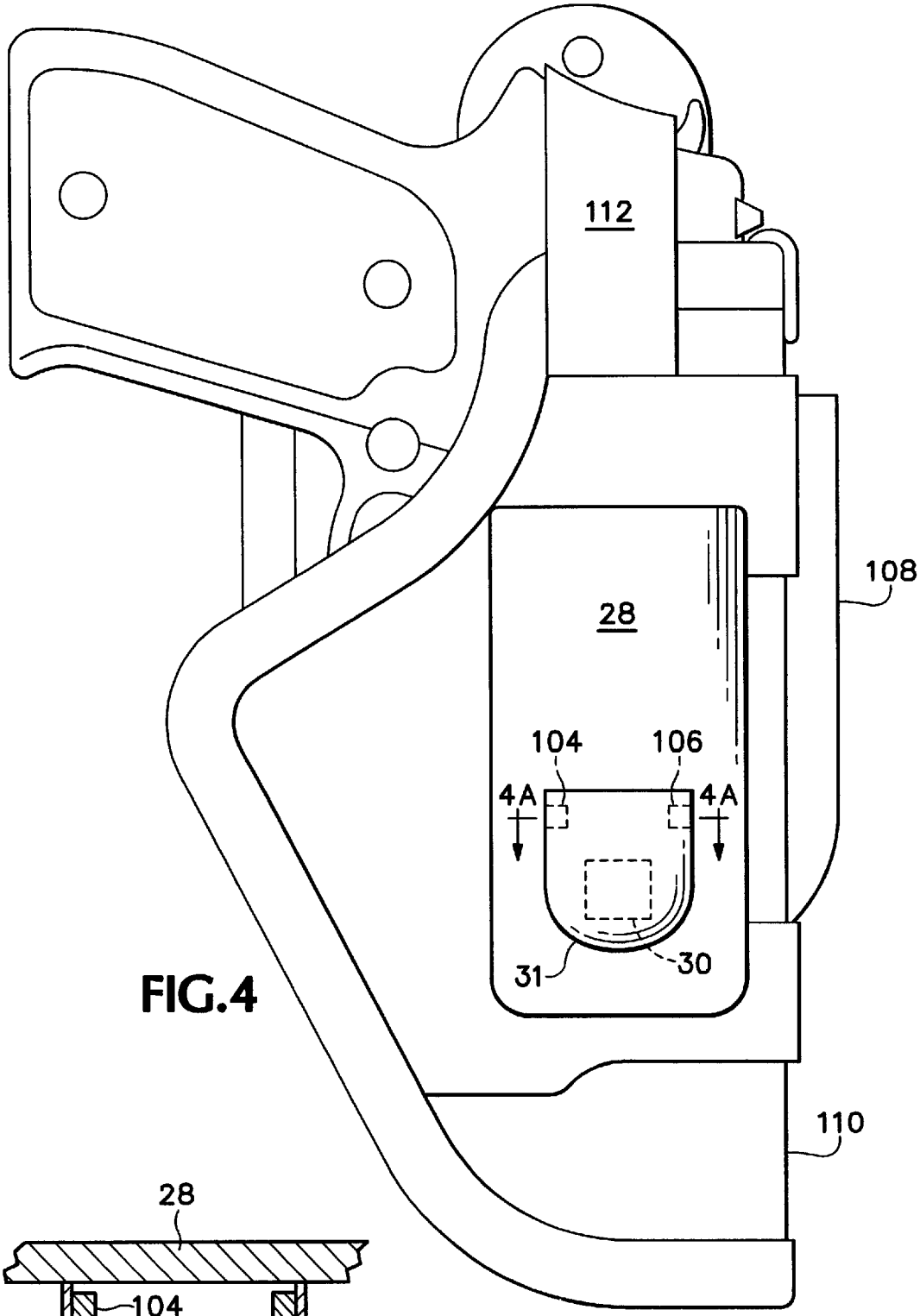
FIG. 4 is a side elevation view of the holster of FIG. 1 showing the fingerprint scanning plate and protective cover.

The holster may have one or more retention devices. FIG. 1 shows a holster with an internal retention device 16, while FIG. 4 shows an external retention device comprised of a strap 112. While an internal retention device is preferred, the various aspects of the invention may also find utility with external retention devices.

BIOMETRIC IDENTIFICATION DEVICE

The holster 10 includes a biometric identification device located on the holster body or otherwise associated with the holster. As used herein, the term biometric identification device means any device capable of reading, scanning or otherwise sensing a personal identifying characteristic of an individual, and producing in response a signal representative of the identifying characteristic. The signal may be either digital,or analog. In one embodiment, shown in FIG. 4, the biometric device is a fingerprint scanning device 28 capable of reading fingerprints and providing a signal representative of the fingerprint. The fingerprint scanning device includes a transparent plate 30 over which a finger is placed in order to be scanned. The fingerprint scanning device may be any conventional fingerprint scanning device that is capable of reading a fingerprint within a few seconds, preferably within one second, and more preferably within less than one second. The fingerprint scanning device should also be capable of accurately discriminating between authorized and unauthorized users. The fingerprint scanning device should be capable of achieving a false acceptance rate of 2% or less, and preferably less than 1%. Preferably, the fingerprint scanning device should also be capable of achieving a false rejection rate of less than 0.1%. It is to be understood that the speed at which the personal characteristic is sensed and the accuracy of the sensing device may be interrelated, and accordingly, the particular speed and accuracy of the sensing device is preferably adjustable so that the speed and accuracy of the sensing device may be selected by the user to optimize the characteristics required for a particular application.

In one preferred embodiment, the fingerprint scanning device is a conventional plate-type device in which the finger is placed or held stationary on top of a transparent plate 30. An example of such a device is model GEZMICRO-6Aa, which may be obtained from GEZ Microsystems in Oakville, Ontario, Canada. This device has the advantage that the finger may be positioned over the plate to allow an accurate scan.

Alternatively, the fingerprint scanning device may be a strip type/scan-across type device, in which the finger to be scanned is dragged across the transparent plate 30 as it is scanned. An exemplary device is an A336 Module from Oxford Micro Devices, Inc., located in Monroe, Conn. This type of fingerprint scanning device has the advantage that it allows the finger to be scanned without interrupting the natural movement of the user's hand during withdrawal of the handgun 12 from the holster 10, allowing the identification of the authorized user to occur rapidly as the handgun is withdrawn.

The present invention may also be used with a variety of alternative biometric devices. For example, the biometric identification device which may be a palm print reader, a voice recognition device, or a shape sensing device, such as a device capable of sensing the shape of a finger and comparing the sensed shape to a stored wire-form shape.

Preferably, the biometric identification device and its associated electronics are mounted on the holster. However, the biometric identification device may be located elsewhere, such as on the belt loop or modular assembly. The biometric identification device may also be mounted on a plug-in device which is mounted into a receptacle mounted on the holster. For example, the biometric identification device may be a fingerprint scanning device mounted on a smart card, which is inserted into a smart card reader mounted on the holster.

The use of a biometric device to unlock or otherwise release the retention device 16 has several advantages over conventional methods for controlling release of a handgun from a holster. The use of a biometric device does not require any additional accessory or identifier to be carried or possessed by the user. Thus, there is nothing to be lost, stolen or used by others to enable unauthorized release of the handgun. Nor is there a risk that the additional accessory or identifier will be damaged or cease to function. In contrast to systems which utilize a separate identifier, such as a pattern generator like a bar code (which, if disfigured will not work) or a single frequency radio transmission (which, if not broadcast will not open the holster), the biometric device of the present invention will always authorize release of the retention device when presented with the authorized individual's fingerprint or other personal identifying feature. In addition, there is no need to locate and position the separate accessory or identifier when withdrawing the handgun. Instead, the fingerprint may be presented as the handgun is being withdrawn from the holster. This may in fact be a lifesaving advantage under circumstances in which the handgun must be rapidly withdrawn from the holster.

Figure 4A:
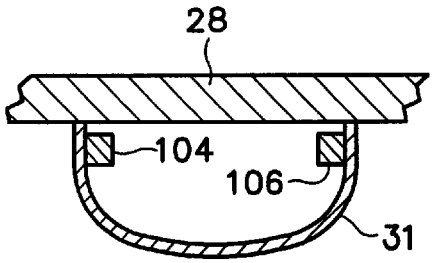
FIG. 4A is a top view of the protective cover for the fingerprint scanning plate.

In a preferred embodiment, the fingerprint scanning device 28 includes a protective cover 31 for protecting the plate 30. FIGS. 4 and 4A show the protective cover. In this embodiment, the protective cover is cup-shaped, so as to receive the end of the finger to be scanned. The cover 31 is preferred for use with fingerprint scanning devices which scan a stationary finger. The cover 31 protects the plate from damage but still allows easy access to the plate 30. In addition, the shape of the cover has the advantage of positioning the fingerprint directly over the plate 30. This has the advantage of improving the speed and accuracy with which the fingerprint is scanned. The cover 31 may also include an infrared emitter 104 and sensor 106 located at the entrance to the cover 31. The emitter and sensor may be used to sense when a finger has been inserted into the cover so as to be scanned. Placing the emitter and sensor at the entrance to the cover has the advantage that the presence of the finger may be sensed prior to its being placed in a position to be scanned.

In an alternative embodiment shown in FIGS. 5–8, the fingerprint scanning device 28 includes a sliding plate protector 32 positioned in a guide area 34. The plate protector 32 is capable of sliding back and forth in the direction of arrow A shown in FIGS. 5–6. The plate protector 32 includes a pair of rails 36 which are received in corresponding slots 38 in the fingerprint scanning device. In a first position, shown in FIG. 5, the protector 32 covers the plate 30 and protects it from the external environment. Thus, the protector 32 protects the plate from being scratched or becoming covered by grease, paint, or debris, which might interfere with the ability of the fingerprint scanning device to quickly and accurately scan a fingerprint.

Figure 6:
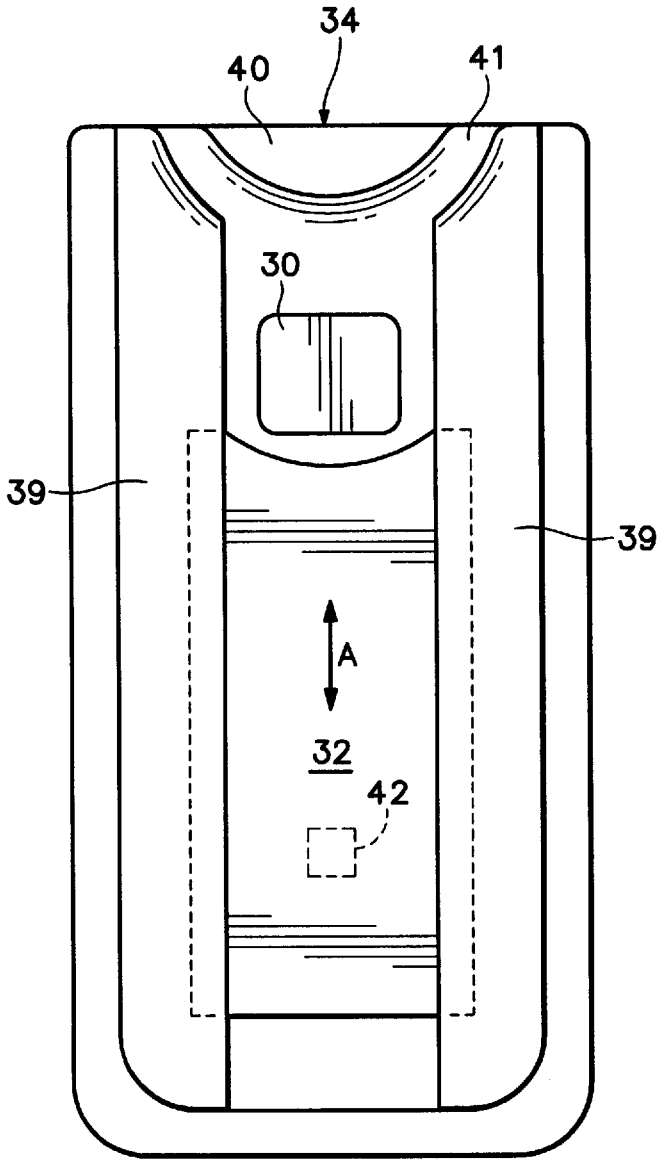
FIG. 6 is a plan view of the fingerprint scanner of FIG. 5 showing the protective cover pushed downward.

The plate protector 32 is movable along the grooves to another position, as shown in FIG. 6, in which the plate is accessible and may be used to scan a fingerprint. In use, to withdraw a handgun, the finger is placed so that the tip of the finger to be scanned pushes against the forward end 33 of the plate protector 32. The finger is then pushed downward so as to slide the plate protector 32 downward to reveal the plate 30, allowing the fingerprint to be scanned.

Figure 7:
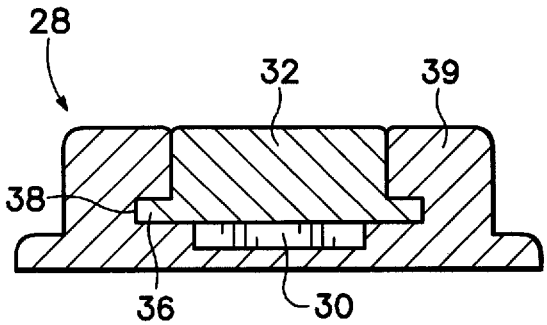
FIG. 7 is a cross-section taken along the line 7—7 of FIG. 5.
Figure 8:
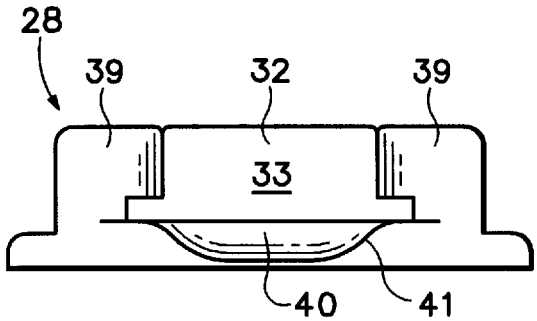
FIG. 8 is a top view of the fingerprint guide area.

The fingerprint scanning device also includes an optional contoured guide area 34 to aid placement of the finger tip over the plate 30 as shown in FIGS. 7 and 8. The guide area 34 includes a hemispherical flat portion 40 which serves to indicate proper placement of the finger tip at the beginning of the scan motion. Adjacent to the flat portion 40 is a raised beveled portion 41 which lifts the fingertip to the level of the plate 30. A pair of contoured side walls 39 define a channel to guide the finger over the plate 30. The guide area 34 of the fingerprint scanning device 28 thus insures that a user may quickly and accurately position his finger over the plate 30 to allow a quick and accurate scan of the fingerprint.

Figure 5:
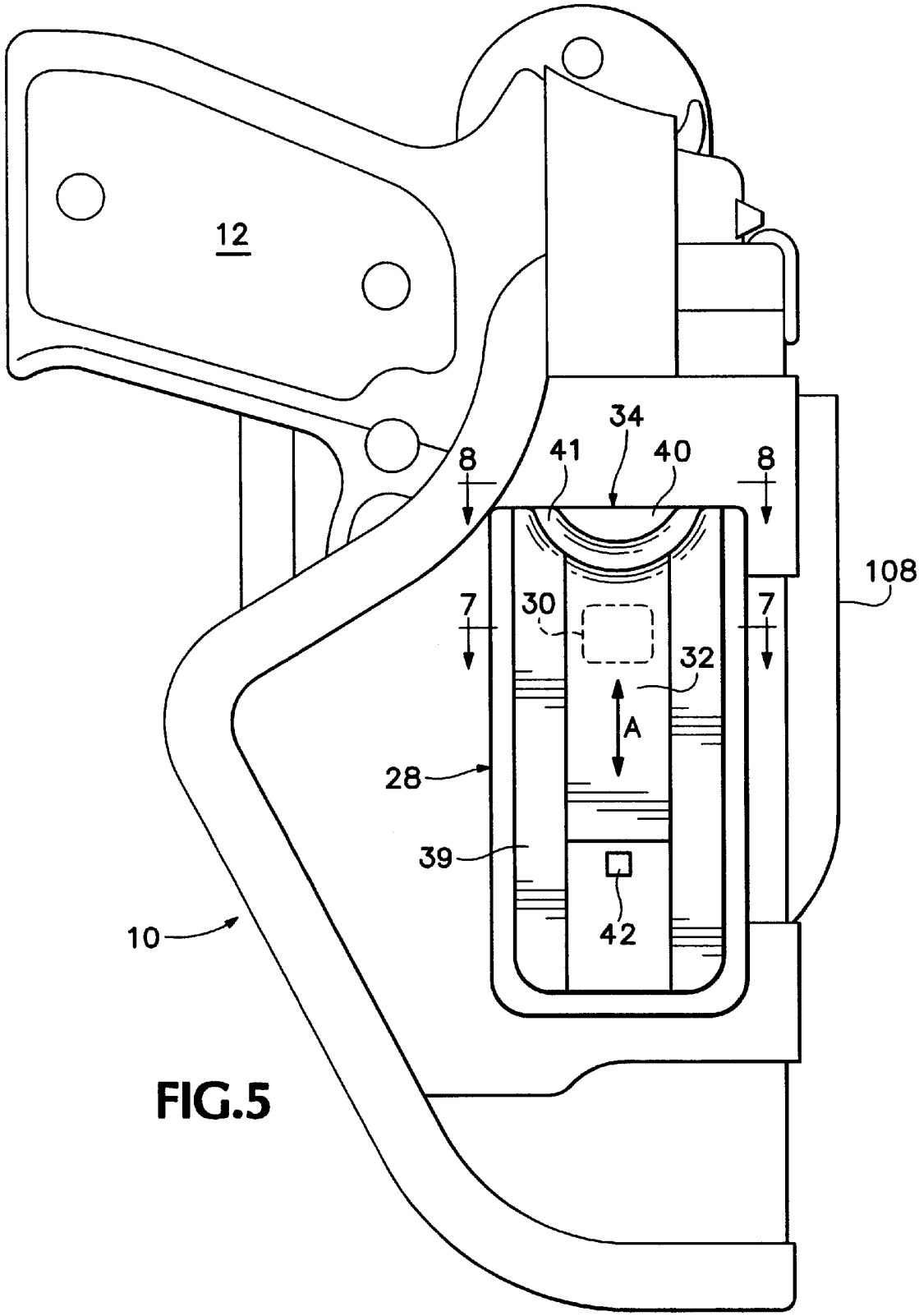
FIG. 5 is a side view of an alternative holster 1 showing a fingerprint scanning plate and an alternative protective cover.

Movement of the sliding plate protector 32 may also optionally be used to control various functions of the holster. For example, FIG. 5 shows a switch 42 at the rear of the fingerprint scanning device. As the plate protector 32 slides rearward, it travels over and depresses the switch 42, as shown in FIG. 6. The switch may provide a signal, condition, or otherwise indicate to the central processor that the plate protector has been moved to allow other holster functions to be activated. Other conventional devices may also be used to sense that a finger has been placed in a position to be scanned. For example, the fingerprint scanning device may sense the presence of a finger over the plate using a pressure sensor or a light sensor.

Retention Device

The holster 10 also includes a retention device 16 that resists withdrawal of the handgun, but is electrically controllable to allow the release of the handgun. The present invention may be used with any retention device that allows for the quick withdrawal of a handgun from the holster, but that also securely holds the handgun within the holster unless withdrawal is authorized. Preferably, the retention device is an internal retention device, as these afford greater resistance to withdrawal of the holster and are protected from external hazards which may damage the retention device.

Figure 2:
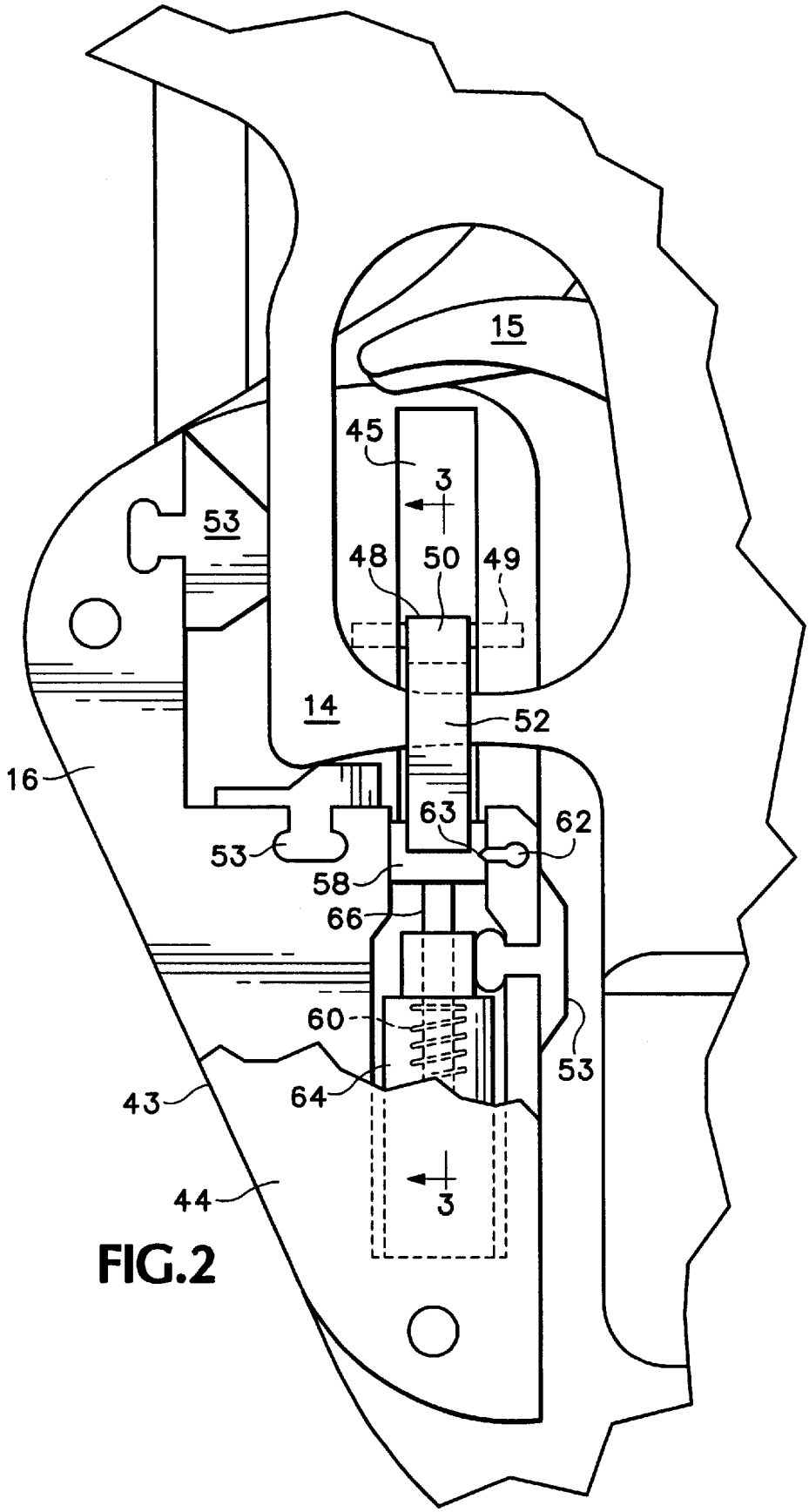
FIG. 2 is a detail side elevation view in partial cutaway of the holster of FIG. 1 showing the internal retention device.
Figures 3A, 3B, 3C:
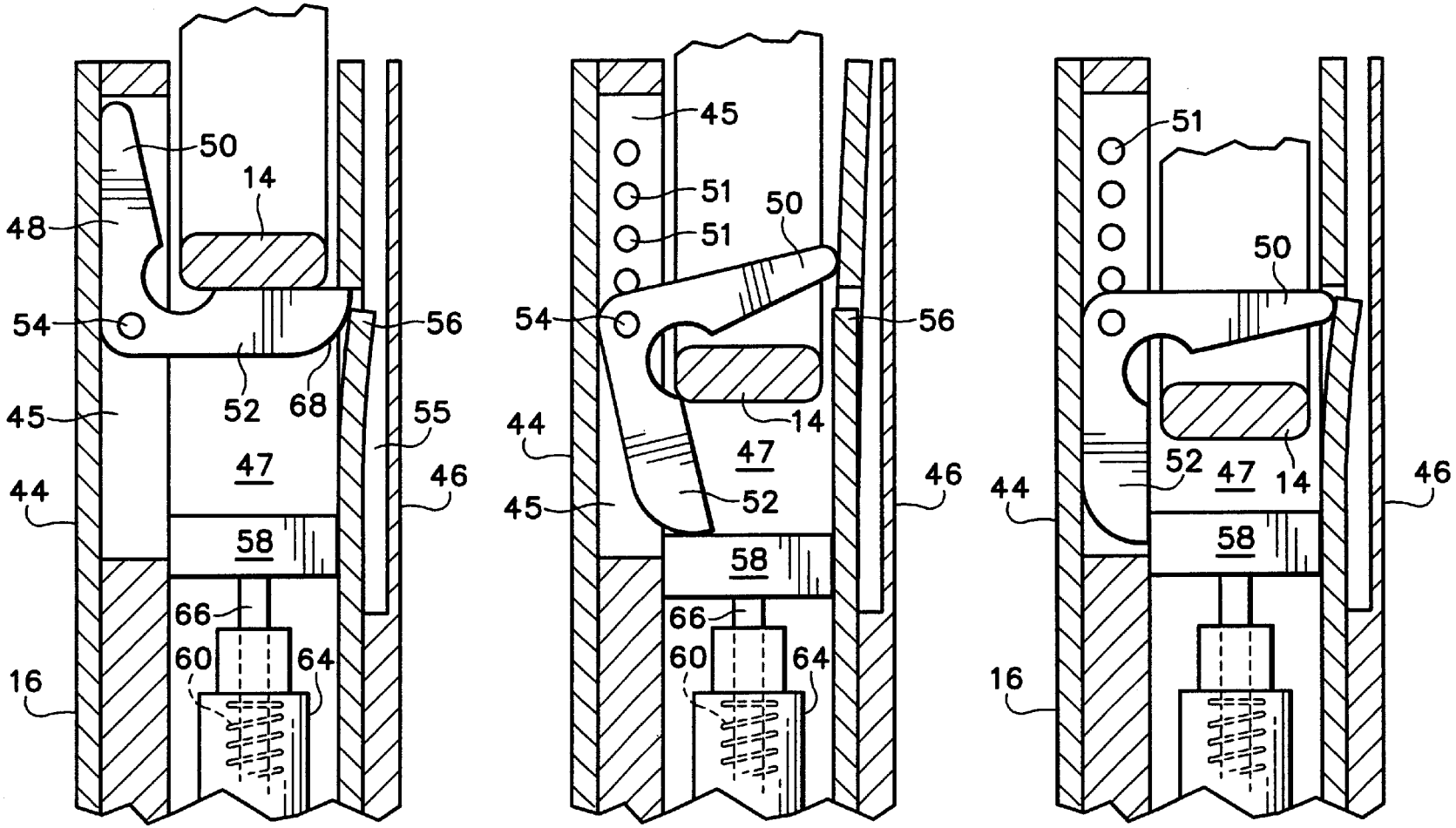
FIG. 3A is a cross-section view along the line 3—3 of FIG. 2 showing a handgun prior to insertion into the holster of FIG. 1.
FIG. 3B shows the handgun partially inserted into the internal retention device.
FIG. 3C shows the handgun fully seated and locked in the internal retention device.

FIGS. 1A and 2–3 illustrate a preferred embodiment of the internal retention device of the present invention. Referring now to FIGS. 1A, 2 and 3A–3B, the internal retention device 16 has a body 42 which includes outer 44 and inner sides 46. The two sides define a cavity 47 for receiving the trigger guard 14 of the handgun. A pivoting catch 48 is mounted to the outer side 44 of the internal retention device 16 (adjacent to the outer side of the holster body) by means of a pin 49 and projects within the cavity 47 toward the inner side 46 of the internal retention device and the inner side 26 of the holster body 22. The outer side 44 has a series of bores 51 for receiving the pin 49. The spacings between the bores 51 allows the position of the catch 48 to be varied within the cavity 47 so as to receive different styles and sizes of handguns with different sizes of trigger guards. In addition, as shown particularly in FIG. 2, the internal retention device 16 may be provided with one or more stops 53 so as to provide an appropriate fit for the handgun within the cavity 47 and/or pocket 18.

The pivoting catch 48 is comprised of a restraining arm 50 and a locking arm 52. In the embodiment shown in FIGS.

3A–3C, the two arms 50 and 52 are oriented at approximately 90° from one another, but other angular orientations may be chosen. The catch 48 may be provided with a notch between the two arms 50 and 52 to provide clearance for the trigger guard during engagement of the trigger guard with the catch. The pivot point 54 is located at the junction of the two arms 50 and 52. When the holster 10 is empty and the handgun has been removed, the locking arm 52 projects within the cavity 47 toward the inner side 46 of the internal retention device 16. As shown in FIG. 3A, the locking arm 52 engages an integral, flexible detent 56 within the inner side 46 of the retention device, which holds the locking arm 52 in place. The flexible detent acts like a leaf spring, and offers some resistance to being pushed away from the cavity 47. Clearance is provided on the opposite side of the detent 56 to allow the detent 56 to be pushed away from the cavity 47. The detent 56 prevents the catch 48 from pivoting, and therefore holds the catch in a position to accept insertion of the appropriate handgun 12. When the locking arm 52 is secured in position by the detent 56, the restraining arm 50 remains positioned within a pocket 45 defined within the outer side 44 of the internal retention device 16. The restraining arm 50 is thus held out of the way so as not to interfere with the insertion of a handgun including a trigger guard into the cavity 47 of the internal retention device.

The internal retention device 16 must be constructed to prevent discharge of the handgun during either insertion or withdrawal. Thus, the relative location of the catch within the cavity, the location of the detent 56, the size and position of the stops 53, and the lengths of the restraining arm 50 and locking arm 52 are chosen to prevent the catch 48 from interfering with the trigger 15 of the handgun. Therefore, the trigger of the appropriate firearm will never engage either arm of the pivoting catch.

As shown in FIG. 3B, when a handgun is inserted into the holster 10 and subsequently into the internal retention device cavity, the handgun's trigger guard 14 engages the locking arm 52 of the pivoting catch 48 and dislodges it from the detent 56 within the inner side 46 of the retention device 16. As the handgun trigger guard 14 moves downward (deeper) into the cavity 47, the locking arm 52 is pushed downward, pivoting the restraining arm 50 of the catch 48 out from within the pocket 45 of the outer side 44 of the internal retention device 16, and behind the trigger guard 14 of the handgun and across the cavity 47 of the internal retention device 16. The restraining arm 50 continues this movement until, as shown in FIG. 3C, it engages the previously described flexible detent 56 within the inner side 46 of the retention device 16.

At the same time, the locking arm 52 of the pivoting catch 48 moves downward, depressing and ultimately passing beyond a moveable blocking member, such as a spring-loaded detent 58 at the bottom of the of the cavity 47. The locking arm 52 then moves into the lower portion of the pocket 45 of the outer side 44 of the internal retention device. The locking arm 52 is thus positioned out of the way so as not to interfere with the insertion of the trigger guard 14 into the lower portion of the cavity 47. As the locking arm 52 of the catch moves past the detent 58, the spring-loaded detent 58 is pushed upward into the cavity 47 by a spring 60 housed within the solenoid. The detent 58 is thus pushed to a position adjacent to the locking arm 52 of the pivoting catch 48 and locks it in place within the pocket 45 of the outer side 44 of the internal retention device 16. Alternatively, the spring used to urge the detent 58 upward may be separate from the solenoid, and may be any type of biasing mechanism suitable to resist downward movement by the detent 58.

Because the detent 58 interferes with movement of the locking arm 52, the catch 48 is prevented from pivoting, and hence the restraining arm 50 is held in a fixed position across the cavity 47. The restraining arm 50 of the catch 48 therefore interferes with and blocks the trigger guard 14 from being withdrawn when the handgun is fully holstered. Any attempt to remove the handgun 12 directly from the holster 10 will be resisted as the trigger guard 14 is prevented from moving or passing by the restraining arm 50.

The internal retention device 16 of the present invention provides another advantage over retention devices which are completely electronically controlled. The present invention allows a handgun to be holstered and secured without the need for electrical power. Thus, a handgun may always be secured notwithstanding a power failure. In addition, because a mechanical mechanism resists withdrawal of the holster, the handgun remains secured even in the event of a loss of electrical power. Moreover, the internal retention device is a passive device, meaning that the retention device is locked and the handgun secured merely by inserting the handgun into the holster. Thus, unlike an active lock which requires an affirmative action in addition to holstering the handgun to secure the handgun in the holster, there is no risk that the user will fail to secure the handgun within the holster once the handgun is inserted into the internal retention device.

The release of the handgun from the internal retention device 16 is electrically controlled through the use of an electrically controlled moveable device such as a solenoid 64. Alternatively, other moveable devices such as a relay or piezoelectric device may be used. The solenoid 64 maintains pressure against and controls downward movement of the bottom-mounted spring-loaded detent 58. The solenoid's normal "at rest" unenergized position is shown in FIGS. 3A and 3C. In the unenergized condition, the solenoid's piston 66 is extended, and therefore the spring causes the detent 58 to be pushed to a raised position. This raised position is shown in FIG. 3C, in which the detent 58 interferes with pivotal movement of the catch 48 by engaging the locking arm 52.

Energizing the solenoid by supplying current causes the piston 66 to withdraw downwardly inside the solenoid, compressing the spring 60, and thus lowering the bottom-mounted detent 58 and allowing the locking arm 52 of the pivoting catch 48 to move out of the pocket 45. The upward movement of the trigger guard 14 as the handgun is withdrawn disengages the restraining arm 50 from the spring-loaded detent 56 within the inner side 46 of the internal retention device. The restraining arm 50 therefore pivots upwardly back across the cavity 47 containing the trigger guard and back into the pocket 45 in the outer wall 44, as shown in FIG. 3A. The handgun is then free to be withdrawn without interference from the catch 48.

Withdrawal of the holster also returns the catch 48 to a position to receive the handgun again. As the catch 48 pivots and the restraining arm 50 returns to the pocket 45 in the outer wall 44, the locking arm 52 engages the flexible detent 56. As shown in FIG. 3A, the detent 56 engages a lower camming surface 68, thus preventing the catch 48 from pivoting. Thus, the catch 48 is held in a position suitable to receive a handgun, and will not pivot to a position that would block insertion of a handgun into the holster.

The use of an electrically controllable moveable blocking member such as the detent 58 provides another advantage. The detent 58 serves as a barrier to the pivoting movement of the locking arm 52 of the pivoting catch 48, instead of clamping or otherwise holding the catch in place. Thus, the force generated by even an extreme attempt to withdraw the handgun 12 from the holster 10 will not only fail to remove the handgun, but will also not bind any part of the internal retention mechanism 16 if withdrawal of the handgun is desired. Only a small amount of force is required to move the detent 58 out from interfering engagement with the locking arm 52. Thus, the handgun may be withdrawn (when authorized) notwithstanding force being exerted to withdraw the handgun. This may be particularly important where the handgun is being withdrawn under duress.

The internal retention device 16 of the present invention provides a further advantage in that power is not required to lock the holster within the internal retention device. Power is only supplied to the solenoid when it is desired to withdraw the handgun. Thus, the holster may retain the handgun for long periods of time without the internal retention device draining power from a power supply, or otherwise requiring a source of power to resist withdrawal of the handgun.

Referring now to FIG. 2, the internal retention device may also be constructed to allow a mechanical override of the internal retention mechanism if desired. For example, the internal retention mechanism may be capable of receiving a mechanical releasing member such as a rod or key, such as a handcuff key. Insertion of the releasing member into the retention device urges the detent 58 downward so as to release the catch. For example, the detent 58 may be provided with a bore 62 in communication with a recess 63 for receiving a key, so that rotation of the key lowers the detent 58 and allows the handgun to be withdrawn. Alternatively, a rod may be inserted into the cavity 47 to depress the detent 58.

While the holster has been described as using a biometric device to provide a signal that is used to determine whether an individual is authorized to withdraw the handgun from the holster, the internal retention device 16 described above may be used in other holster embodiments which use additional or alternative mechanisms for determining whether to release the internal retention device. For example, the holster may include a switch, such as a push button, to provide power to the solenoid. Alternatively, power may be supplied to the solenoid in response to a key, key code, or data representative of an authorized individual.

Alternatively, the internal retention device may be comprised of another type of mechanical locking mechanism that is capable of resisting withdrawal of the handgun from the holster. For example, the internal retention device may be comprised of a device in which the solenoid actively locks the handgun into position. For example, the solenoid piston may be extended so as to interfere with the trigger guard upon removal of the handgun from the cavity 47. Alternatively, the locking device may be comprised of a pair of jaws that surround and grip the trigger guard when locked, may be comprised of a pair of plates that are contoured to match some or all of the external features of the handgun when locked, or a mandrel which may be inserted into the bore of the handgun.

Computer System

The holster 10 also includes a computer system that allows identification of an authorized individual to release the internal retention device and thereby allow withdrawal of the holster, and optionally to perform other functions as well. The holster 10 has a microprocessor 70 (shown schematically in FIG. 9) which is used to receive signals from the biometric device, such as the fingerprint scanning device 28. The holster 10 has memory 72, such as in the form of Electronically Erasable Programable Read Only Memory (EEPROM), which is connected to the microprocessor 70. Collectively, the microprocessor 70 and associated memory 72 comprise the computer system. The computer system which may be used in the present invention may be any device, whether a microprocessor alone or in combination with other processors and/or memory devices, which performs the functions described herein relating to the reading, writing, deleting, storing and comparing of information relating to signals received from the biometric device, as well as signals received from other input devices.

The computer system may also be built into the biometric device itself, or may be separate therefrom. In addition, the computer system may be incorporated either directly into the holster, or may be associated with the holster but not mounted on the holster body. Preferably, the computer system is located within the holster body proximate the biometric identification device. Alternatively, the computer system may be mounted within a support 108 that is attached to the exterior of the spine 110 of the holster. The support may be detachable so as to be replaceable. Alternatively, the computer system may be part of a modular assembly 74 worn on the user's belt 76 and connected to the holster through electrical connections.

In a preferred embodiment, the fingerprint scanning device itself includes a reader microprocessor that provides the function of comparing scanned fingerprints against stored data, and generates a signal to a second microprocessor to indicate whether a scanned fingerprint matches that of an authorized individual. The second microprocessor then controls the internal retention to allow the handgun to be withdrawn from the holster.

Figure 9:
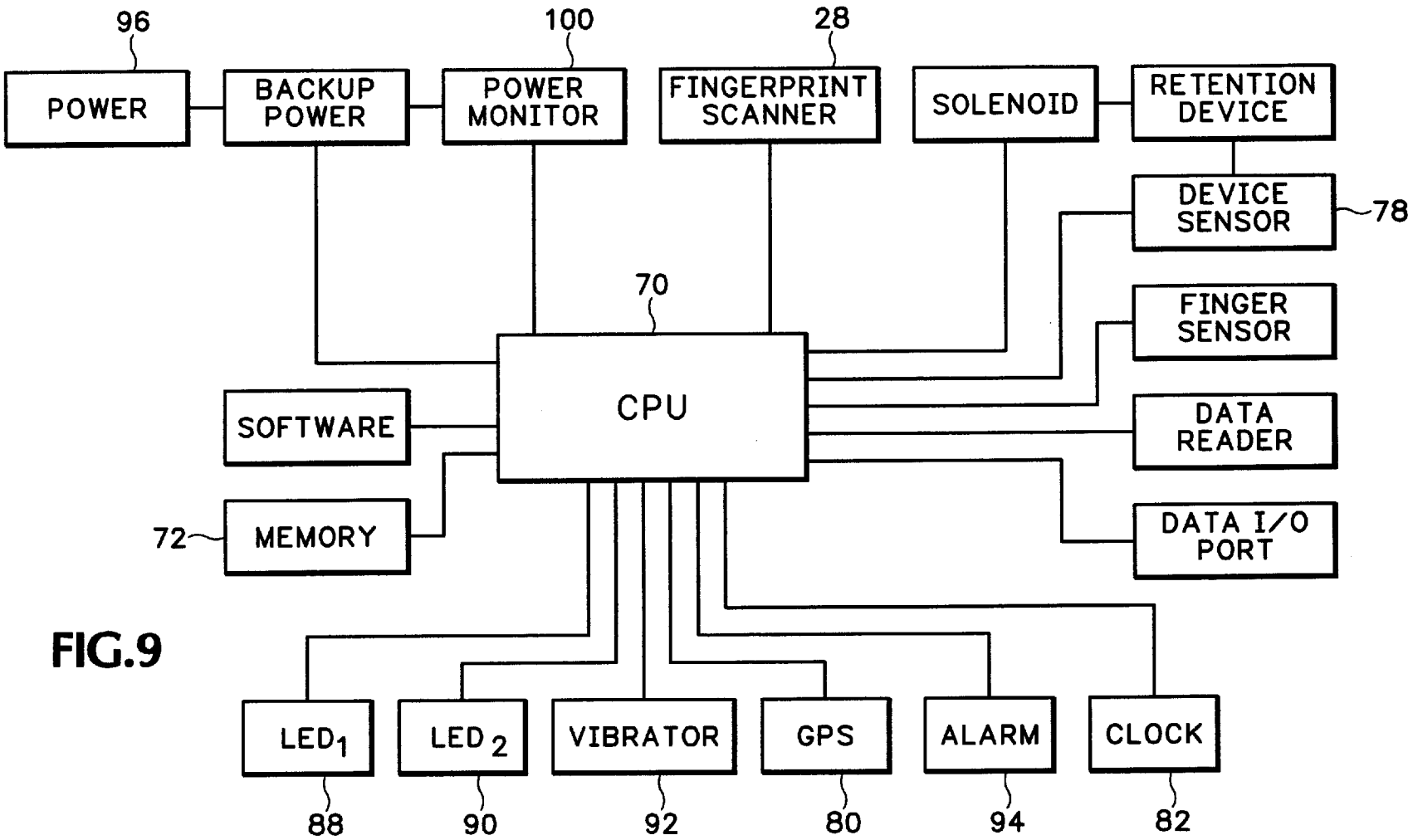
FIG. 9 is a block diagram showing schematically the electrical components of a holster of the present invention.
Figure 10:
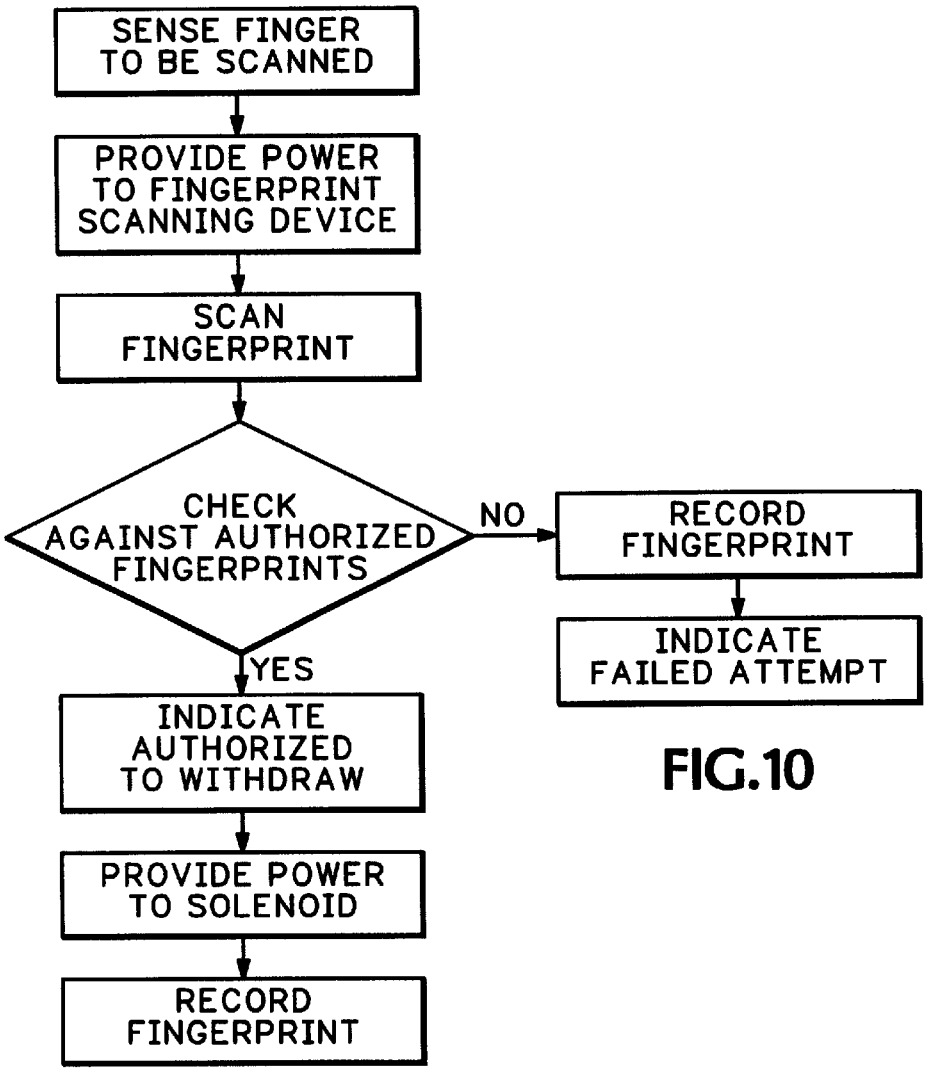
FIG. 10 is a flow chart showing the steps involved in response to an indication that a fingerprint signal is to be read.

In operation, the computer system controls the operation of the internal retention device 16 to allow withdrawal of the handgun. As shown in FIG. 9, a microprocessor 70 is connected to at least the biometric device, such as the fingerprint scanning device 28, as well as other optional inputs. Data representative of the identifying characteristics of individuals authorized to open the holster may be stored in the memory 72. When the fingerprint scanning device 28 scans a fingerprint, a signal representative of the fingerprint is sent to the microprocessor 70. The microprocessor compares the signal to the data stored in memory 72 to determine whether there is a match. If the identifying characteristic matches, then the microprocessor 70 generates a signal effective to release the internal retention device 16. For example, as shown in FIG. 10, the microprocessor is connected to the solenoid so that when it receives the appropriate signal from the microprocessor, power is provided to the solenoid 64. Alternatively, the microprocessor may be connected to a switch or other device which causes power to be supplied to the solenoid.

In either case, the microprocessor or fingerprint scanning device may be configured to allow the desired or required degree of confidence when determining whether a match has been made to be varied. For example, a user may adjust the microprocessor to require a high degree of confidence, or may require only a low degree of confidence, depending on the particular needs of the user.

The memory 72 used to store data may be any conventional memory device as described above. Thus, the memory may be integral to the computer system, such as a memory chip, may be in the form of a portable memory storage device such as magnetic storage media, or may be a combination thereof. Thus, the memory could include a portable magnetic or optical disk or diskette, or could be a smart card. For example, in one embodiment, the modular assembly 74 may include a smart card reader capable of reading data stored on a smart card. The data representative of authorized users may be stored on the smart card. Inserting the smart card into the smart card reader allows data representative of the authorized individual to be easily installed in the computer system. The use of a portable memory storage device also provides an advantage in that authorized users may be easily changed. In addition, the portable memory storage device may be switched from one holster to another holster for a variety of reasons, if deemed necessary.

As yet another optional feature, the use of a portable memory storage device may be used as a key to allow authorization to withdraw the holster. The data representative of the individual may be prestored in a memory associated with the microprocessor. When a portable memory storage device is inserted into a data reader, the microprocessor checks for a match against the prestored data. If a match is found, the holster may be used. Otherwise, the holster remains inactive.

The holster 10 may optionally include a number of other inputs to the microprocessor. For example, the holster may include a switch 42 associated with the fingerprint scanning device which sends a signal to the microprocessor 70 in response to movement of the plate protector 32 across the switch 42. In response to receiving a signal from the switch 42, the microprocessor may send a signal to a switch or relay to allow power to be provided to the fingerprint scanning device. Power may be supplied for a limited time, for example for 3 seconds, in order to conserve power. Preferably the length of time may be adjusted, for example from 2 to 10 seconds.

The holster may also optionally include a strain gauge 78 associated with the internal retention device, such as the catch 48. The strain gauge 78 provides a signal or condition in response to pressure being applied against the catch. The microprocessor may use the signal received from the strain gauge to initiate another function, such as sending a signal to one of the outputs. Thus, the strain gauge may be used to sense when a handgun has been inserted into the holster, and when an attempt has been made to withdraw the handgun from the holster. Other sensing devices may be used to sense insertion or withdrawal of a handgun.

The holster may also optionally include a Global Positioning System ("GPS") receiver 80 to determine the geographical location of the holster. The holster may also optionally include a clock 82. Signals from the GPS receiver and clock may be used as inputs for the computer system.

The holster may also include a variety of outputs which may be used to indicate the status of the holster, or to which data, signals or conditions may be sent to indicate the status of the holster or otherwise transmit information. For example, the holster may include one or more LEDs, such as LEDs 88 and 90, which may indicate certain conditions of the holster. For example, the microprocessor may send a signal to LED 88 when an authorized fingerprint has been scanned and the handgun may be withdrawn, but send a signal to LED 90 to indicate that a match has not been made. Alternatively, the holster may be equipped with a vibrator 92 connected to the microprocessor to perform the same function.

The holster may also include an alarm mechanism 94 to which a signal or data may be sent. The alarm mechanism 94 may be an audible alarm, such as a speaker, or could be a broadcast mechanism, such as a radio transmitter. In response to a signal from the switch 42 and/or the strain gauge 78, the microprocessor may send a signal, data or condition to the alarm mechanism 94. For example, where the alarm mechanism is a speaker, the alarm mechanism may simply emit a sound. Where the alarm mechanism 94 is a radio transmitter, the alarm mechanism may broadcast that an attempt has been made to withdraw a holster, as well as other data, such as the location of the holster, the time of withdrawal, and the identity of the individual attempting the withdrawal (if known). Alternatively, where the holster is used as a storage device, the alarm may be in the form of a signal to a home security system.

The holster may also optionally provide an audit of activity of the holster by storing data received from one or more of the inputs in response to certain input signals. For example, the microprocessor may store any or all of the data received from the fingerprint scanner, the strain gauge, the GPS receiver to record the location of an event, and/or the clock to record the time of the event.

The holster 10 may also include an input/output device to allow data to be retrieved from or sent to the memory 72 and/or instructions to be provided to the microprocessor. This may be accomplished in any conventional manner. For example, data may be transmitted using an infra-red communication system, such as those which operate in conformance with IRDA standards. The holster 10 may have an emitting diode and transmitting diode to allow infrared communication with the microprocessor. Data may also be communicated over a cable using an RS232 communication standard. For example, the holster and/or modular assembly 74 may include an RS232 cable connector to allow communication with external devices using an RS232 communication protocol. The holster therefore may be used to receive or send data to a personal computer, such as, for example, a Palm Pilot™ sold by PALM which includes infrared communication capabilities and the ability to communicate over a cable. Data may also be transmitted using any other standard method for transmitting digital information, including any analog or digital telecommunication protocol, including wireless communication and communication over the Internet.

The computer system may also allow the holster to be disabled remotely. The computer system may be capable of receiving a signal from a remote location indicating that the holster should be disabled. In response, the computer system may disable the holster so that the retention device may not be released. Thus, for example, in response to an alarm indicating that an unauthorized attempt to withdraw the holster has occurred, a remote monitoring device could send a signal to the holster to disable the holster, preventing the retention device from allowing withdrawal of the handgun.

The computer system may also allow the holster to be disabled automatically in response to certain inputs. For example, the computer system may be capable of receiving a signal from either the clock or the GPS receiver. The computer system may be programmed so that the holster may be withdrawn only during specified times, or only within certain locations. Thus, if the user attempts to withdraw the handgun from the holster at an unauthorized time, or at an unauthorized location, the computer system disables the retention device so that the holster is disabled, thus preventing the retention device from allowing withdrawal of the handgun. Likewise, if the user attempts to withdraw the holster during an authorized time period, or at an authorized location, the computer system allows the handgun to be withdrawn from the holster.

Power for the various components of the holster may be provided in any conventional fashion. For example, the holster may include a power supply 96 such as a detachable power pack included as part of the support 108 of the modular assembly 74. Such a power supply may utilize standard batteries of any size, specialized material batteries (nickel, cadmium, lithium, etc.) of any size or a rechargeable module. The holster may also include electrical contacts so that the holster may be powered using conventional common voltages (110 v ac, 220/240 v ac or 12 v dc) to energize the solenoid and the related electronics. This would be desirable in circumstances in which the holster is used as a storage or security device, and/or to allow the power supply to be recharged.

The holster may further include a reserve power supply 98 to be used in the event the power supply becomes drained. The holster may include a power monitor 100 to sense the amount of power provided by the power supply 96, and in response, send a signal or condition to the microprocessor representative of the power or change in power provided by the power supply 96. A switch 102 or other mechanism may be provided that is connected to the microprocessor which allows the reserve power supply to be used in the event that the power supply lacks sufficient power to enable use of the holster. For example, the reserve power supply may be a spare battery or a capacitor which stores sufficient energy to energize the solenoid for one or more additional withdrawals.

The holster may also include a variety of functions to conserve power. For example, the fingerprint scanning device 28 may be supplied with power only in response to a signal from switch 42 or other sensing device. In addition, the solenoid may only be energized for a short period of time after an authorized fingerprint has been matched. The duration of this period may be preset or may be adjusted by the user. The holster may also include a switch or other mechanism (such as a key) to turn the holster on or off. Such a switch or mechanism could be associated with a portable memory storage device reader, such as a smart card reader, so that insertion of the portable memory storage device temporarily turns the holster on. If a match is made, the holster would remain on, while if no match is made, the holster would turn off.

Figure 11:
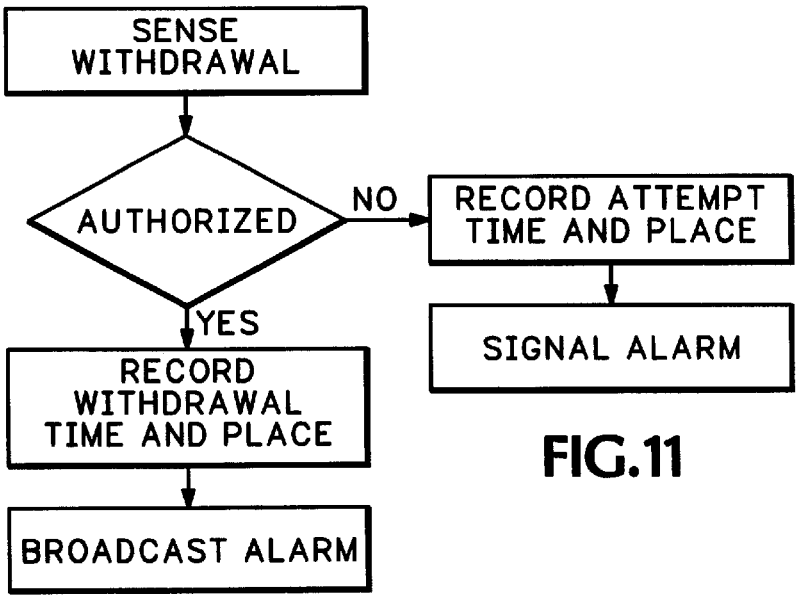
FIG. 11 is a flow chart showing the steps involved in response to an attempt to withdraw the handgun from the holster.

Turning now to operation of one embodiment of the invention, FIGS. 10 and 11 are flow charts showing exemplary steps involved in the operation of a holster of the present invention. FIG. 10 shows the steps taken in response to movement of the plate protector 32. After receiving a signal from the switch 42, power is supplied to the fingerprint scanning device 28. The fingerprint is then scanned, and the data representative of the fingerprint is sent to the microprocessor. The microprocessor checks for a match. If a match is made, power is supplied to the solenoid and to an output such as a vibrator and/or LED to indicate that the holster may be withdrawn.

FIG. 12 shows the steps involved in response to an attempt to withdraw the handgun. The strain gauge sends a signal to the microprocessor representative of an attempt to withdraw the handgun. The microprocessor checks to determine whether the withdrawal has been authorized. If yes, then the microprocessor stores the fingerprint data, time, and location of the withdrawal in the memory. The microprocessor also sends a signal to the alarm indicating that an authorized withdrawal has been made. If the withdrawal is not authorized, the fingerprint data, time and location are stored in memory, and sends a signal to the alarm that an unauthorized attempt to withdraw the handgun has been made.

While the computer system and associated inputs and outputs have been described as for use in connection with a holster having an electrically controlled retention mechanism, the computer system and associated inputs and outputs find utility with other holsters as well. A sensor, such as a strain gauge or other device, may be connected to a mechanical lock, or within the holster pocket, to sense the insertion and withdrawal of a handgun from the holster. The computer system may use a signal from the sensor to create and store a record of the insertion and withdrawal of a handgun from the holster based on time and optionally location. Thus, for example, when used as a holster for law enforcement personnel, the holster may be downloaded at the beginning and end of every shift to read the record of activity of the holster. This feature may be used independently of any associated lock and/or biometric identification device.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A handgun holster for securely holding a handgun, the holster comprising:

(a) a holster body defining a handgun receiving pocket;

(b) a retention device proximate to said pocket capable of selectively resisting withdrawal of said handgun from said holster; and (c) a biometric device capable of sensing a characteristic of an individual, and being effective to control said retention device so as to release said handgun from said holster.

2. The holster of claim 1 further comprising an alarm mechanism connected to said holster.

3. The holster of claim 1 wherein said retention device may be released using a mechanical releasing member.

4. The holster of claim 1 wherein said retention device is an internal retention device.

5. The holster of claim 4 wherein said internal retention device further includes a moveable catch and a movable blocking member and said moveable blocking member is capable of moving from a first position to a second position, said moveable blocking member in said first position interfering with movement of said catch, and said moveable blocking member in said second position allowing movement of said catch.

6. The holster of claim 4 wherein said internal retention device secures said handgun in response to insertion of a trigger guard of said handgun into said internal retention device.

7. The holster of claim 1 wherein said biometric device is a fingerprint scanning device.

8. The holster of claim 7 wherein said fingerprint scanning device includes a plate cover.

9. The holster of claim 7 wherein said fingerprint scanning device includes a finger positioning device.

10. The holster of claim 1 further comprising a computer system, said computer system storing data in response to at least one of receiving a signal from said biometric device and withdrawal of said handgun from said holster.

11. The holster of claim 10 wherein said data is a fingerprint.

12. The holster of claim 10 further comprising at least one of a clock and a GPS receiver and wherein said computer system makes said data available for retrieval at a later time and said data includes at least one of a time and a location.

13. A handgun holster system for securely holding a handgun, comprising:

(a) a holster body defining a handgun receiving pocket;

(b) an internal retention device proximate to said pocket capable of resisting withdrawal of said handgun from said holster, said internal retention device including a catch capable of resisting withdrawal of said handgun from said holster, and a moveable blocking member;

(c) said blocking member being moveable between a first position and a second position, said blocking member in said first position interfering with movement of said catch, and in said second position allowing movement of said catch.

14. The holster of claim 13 wherein said catch includes a restraining arm and a locking arm.

15. The holster of claim 13 wherein said internal retention device further includes a biasing mechanism associated with said blocking member to urge said blocking member into interfering relationship with said catch.

16. The holster of claim 13 wherein said moveable blocking member is associated with an electrically moveable device.

17. The holster of claim 13 further comprising an alarm mechanism connected to said holster.

18. The holster of claim 13 wherein said internal retention device may be released using a mechanical releasing member.

19. The holster of claim 13 further comprising a detent capable of resisting movement of said catch when said catch is positioned to allow insertion of a trigger guard of said handgun into said internal retention device.

20. The holster of claim 13 wherein said retention device secures said handgun in response to insertion of a trigger guard of said handgun into said internal retention device.

21. The holster of claim 13 further comprising a computer system, said computer system storing data in connection with withdrawal of said handgun from said holster.

22. The holster of claim 21 wherein said data is a fingerprint.

23. The holster of claim 21 further comprising at least one of a clock and a GPS receiver and wherein said computer system makes said data available for retrieval at a later time and said data includes at least one of a time and a location of the holster.

24. The holster of claim 13 further comprising a biometric device, said biometric device being effective to cause said blocking member to move from said first position to said second position.

25. The holster of claim 24 wherein said biometric device is a fingerprint scanning device.

26. The holster of claim 25 wherein said fingerprint scanning device includes a plate cover.

27. The holster of claim 25 wherein said fingerprint scanning device includes a finger positioning device.

28. A handgun holster system for securely holding a handgun, comprising:

(a) a holster body defining a handgun receiving pocket;

(b) a sensing device capable of sensing at least one of insertion of said handgun into or an attempt to withdraw said handgun from said holster and generating a signal in response to at least one of insertion and withdrawal of said handgun;

(c) a computer system associated with said holster and connected to said sensing device, said computer system being associated with a clock, and said computer system, in response to receiving said signal from said sensing device, storing data representative of said signal and of a corresponding time and making said data available for retrieval at a later time.

29. The holster of claim 28 wherein said holster further includes a GPS receiver and said computer system, in response to receiving said signal from said sensing device, stores data representative of a location received from said GPS receiver.

* * * * *